US008276528B1

(12) United States Patent
Higgins et al.

(10) Patent No.: US 8,276,528 B1
(45) Date of Patent: Oct. 2, 2012

(54) PNEUMATIC FUEL DISTRIBUTOR FOR SOLID FUEL BOILERS

(76) Inventors: Daniel Richard Higgins, Tigard, OR (US); Eugene Sullivan, Mobile, AL (US)

( * ) Notice: Subject to any disclaimer, the term of this patent is extended or adjusted under 35 U.S.C. 154(b) by 832 days.

(21) Appl. No.: 12/406,035

(22) Filed: Mar. 17, 2009

Related U.S. Application Data

(60) Provisional application No. 61/037,169, filed on Mar. 17, 2008.

(51) Int. Cl.
*F23K 3/18* (2006.01)
*F23K 3/02* (2006.01)
*F23L 13/00* (2006.01)

(52) U.S. Cl. ..... 110/111; 110/104 R; 110/293; 110/313; 406/194

(58) Field of Classification Search ..... 110/101 R, 110/104 R, 105, 108, 111, 286, 293, 297, 110/301, 309, 310, 313; 239/505, 506, 509, 239/510, 511, 512, 513, 521, 537, 538, 539, 239/540, 541, 581.1, 581.2, 583, 584, 654; 198/493, 2 R, 4, 28, 34; 454/63, 64, 152, 454/155

See application file for complete search history.

(56) References Cited

U.S. PATENT DOCUMENTS

| | | | | |
|---|---|---|---|---|
| 2,213,923 | A | | 9/1940 | Stuart et al. |
| 2,250,067 | A | | 7/1941 | Martin |
| 3,976,018 | A | | 8/1976 | Boulet |
| 4,170,183 | A | | 10/1979 | Cross |
| 4,254,715 | A | | 3/1981 | LaHaye et al. |
| 4,423,533 | A | | 1/1984 | Goodspeed |
| 4,577,363 | A | | 3/1986 | Wyse |
| 4,635,379 | A | | 1/1987 | Kroneld |
| 4,642,048 | A | | 2/1987 | Kim |
| 4,676,176 | A | | 6/1987 | Bonomelli |
| 4,822,428 | A | | 4/1989 | Goodspeed |
| 4,872,834 | A | | 10/1989 | Williams, Jr. |
| 4,884,516 | A | | 12/1989 | Linsen |
| 4,976,208 | A | | 12/1990 | O'Connor |
| 5,001,992 | A | * | 3/1991 | Higgins et al. ..... 110/182.5 |
| 5,069,146 | A | | 12/1991 | Dethier |

(Continued)

FOREIGN PATENT DOCUMENTS

JP 08245072 * 9/1996

OTHER PUBLICATIONS

"Diamond Rodding Robot," http://www.diamondpower.com.au/pdf/diamondpower/AncillaryEquipment/Rodding_robot.pdf.

*Primary Examiner* — Kenneth Rinehart
*Assistant Examiner* — David J Laux
(74) *Attorney, Agent, or Firm* — Scheinberg & Associates, PC; Michael O. Scheinberg; Shitong Sun

(57) ABSTRACT

A pneumatic fuel distributor for solid fuel boilers is described incorporating in various embodiments one or more of the following features: a converging nozzle section, a converging adjustable orifice section and an integral trajectory plate. The nozzle, orifice and trajectory plate are preferably all interconnected and rotate together about a common axis. The orifice damper is, in one embodiment, a rotating convergent section and independently adjustable. The unit preferably incorporates a viewing glass and access port and the rotating components are preferably removable for maintenance. The unit is preferably reversible for left or right hand installation and the trajectory plate is easily replaceable.

16 Claims, 5 Drawing Sheets

U.S. PATENT DOCUMENTS 5,226,375 A 7/1993 Fukuda
5,239,935 A * 8/1993 Morrow et al. ..... 110/104 R
5,313,892 A 5/1994 Tice
5,401,130 A 3/1995 Chiu et al.
5,414,887 A 5/1995 Abel et al.
5,724,895 A 3/1998 Uppstu
5,794,548 A * 8/1998 Barlow ..... 110/104 R
6,047,970 A 4/2000 Friend et al.
6,358,042 B1 3/2002 Moriguchi
6,532,880 B2 3/2003 Promuto
2009/0270817 A1 10/2009 Moreno et al.

* cited by examiner

PNEUMATIC FUEL DISTRIBUTOR FOR SOLID FUEL BOILERS

This application claims priority from U.S. Provisional Patent Application No. 61/037,169, which is hereby incorporated by reference.

TECHNICAL FIELD OF THE INVENTION

The present invention relates to fuel distributors for solid fuel boilers.

BACKGROUND OF THE INVENTION

Pneumatic solid fuel distributors are well known in the operation of boilers to improve the distribution of fuel in the boiler. They typically feed bark, "hog fuel" (mixtures of bark and cardboard, sludge, or other waste materials), coal, and/or other solid fuels, separately or combined. They are also referred to as "bark distributors" or "wind swept spouts". Common designs incorporate a nozzle section (fixed or pivoting) and a pivoting trajectory plate to adjust the angle at which the solid fuel is injected into the boiler. The trajectory plate pivots about a horizontal axis thereby controlling the vertical angle at which the fuel is injected. A more recent design incorporates a flexible trajectory plate and a means for spreading the fuel in a broader horizontal pattern.

Solid fuel boilers are typically constructed as large boxes (up to 100 $m^2$ or more floor area) with heavy steel tubing forming the walls of the box, typically referred to as the front, sides, and rear walls. The tubing is typically 63.5 mm or 76.2 mm outside diameter, arrayed in parallel relationship forming flat panels with the tubes running vertically. The tubes are typically spaced apart about 10-12 mm with a steel membrane or fin bridging the gap. The whole assembly is seal welded together forming an air tight structure. The boiler walls, or tube panels, run vertically to the top of the boiler, up to 30 m or more tall. The walls are fed re-circulating water by headers at their lower extremity. Typically the front wall tubes are bent over more or less horizontally to form the roof of the boiler and the side walls end in relieving headers feeding back to a steam drum. The rear wall either ends in a header or feeds directly into the steam drum. In order to feed fuel and combustion air into the boiler, and for other purposes, the boiler tubes are bent apart to form openings in the tube panel.

The bottom of the boiler may be arranged as a grate type boiler, fluidized bed boiler, or other arrangement. Grate type boilers include traveling grates, vibrating grates, tilting grates, and hydro-grates. Typically the grates cover the bottom of the boiler and are made of heavy cast iron components with slots for combustion air to rise through the grate from a plenum below. The solid fuel lands on the grate and burns there. The ash is dumped off of the grate as the grate moves (rotates like a tank tread), vibrates, or tilts (in sections). Fluidized bed boilers generally have a mass of sand or other media through which a stream of air or boiler flue gas is percolated to fluidize the bed. The fluidized bed acts as a heat sink, turbulent fuel/air mixing system, fuel distribution system, and means for separating fuel and ash in the boiler. Additional combustion air ports, typically called "over fired air" (OFA) are arranged to blow air in above the grate or fluidized bed to help complete the combustion. In all of these arrangements if the fuel is not properly distributed on the grate or fluidized bed, poor combustion can result leading to poor operational efficiencies and high environmental emissions.

In current practice the solid fuel is fed by gravity through large chutes, steeply mounted and about 500 mm square, from a hopper and/or conveyor system above, to the lower portion of the boiler just above the grate or fluidized bed. There are typically multiple chutes penetrating a wall or walls of the boiler. The solid fuel distributor is often integral with and at the bottom of the chute right at the interface with the boiler wall. Mechanical distributors and pneumatic distributors are commonly used. Grate type boilers generally require some type of fuel distribution whereas fluidized bed boilers can be run without them as the fluidized bed can distribute the fuel, albeit inefficiently. In the case of the pneumatic fuel distributor, the solid fuel slides down the chute, passes across the pneumatic orifice and hits the trajectory plate where it is blown off and into the boiler by the pneumatic media. A recent variation attempts to develop a boundary layer of pneumatic media along the top of the trajectory plate such that the solid fuel does not contact the plate. In any case it is the flowing pneumatic media that propels the solid fuel into the boiler.

SUMMARY OF THE INVENTION

An object of the invention is to provide an improved pneumatic fuel distributor for a solid fuel furnace.

The present invention provides an improved fuel distributor for a solid fuel boiler. A preferred fuel distributor includes several novel aspects, not all of which need be present in all embodiments. Some embodiments of the invention use a converging nozzle section that provides improved fluid flow to distribute fuel more evenly. Some embodiments of the invention include an adjustable orifice that efficiently controls the flow at the exit of the nozzle, rather than upstream of the nozzle. Some embodiments include nozzle surfaces that converge toward the orifice to efficiently guide the pneumatic flow to and through the orifice. Some embodiments of the invention include an integral trajectory plate in which the nozzle, orifice and trajectory plate are all interconnected, preferably by a frame, and rotate together about a common axis. Some embodiments of the invention allow for easy removal of the distributor from the boiler. Some embodiments of the invention provide an access port that can be used to clean the unit in case it gets plugged and a viewing port that allows an operator to see into the distributor.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more through understanding of the present invention, and advantages thereof, reference is now made to the following descriptions taken in conjunction with the accompanying drawings, in which.

Figure 1:
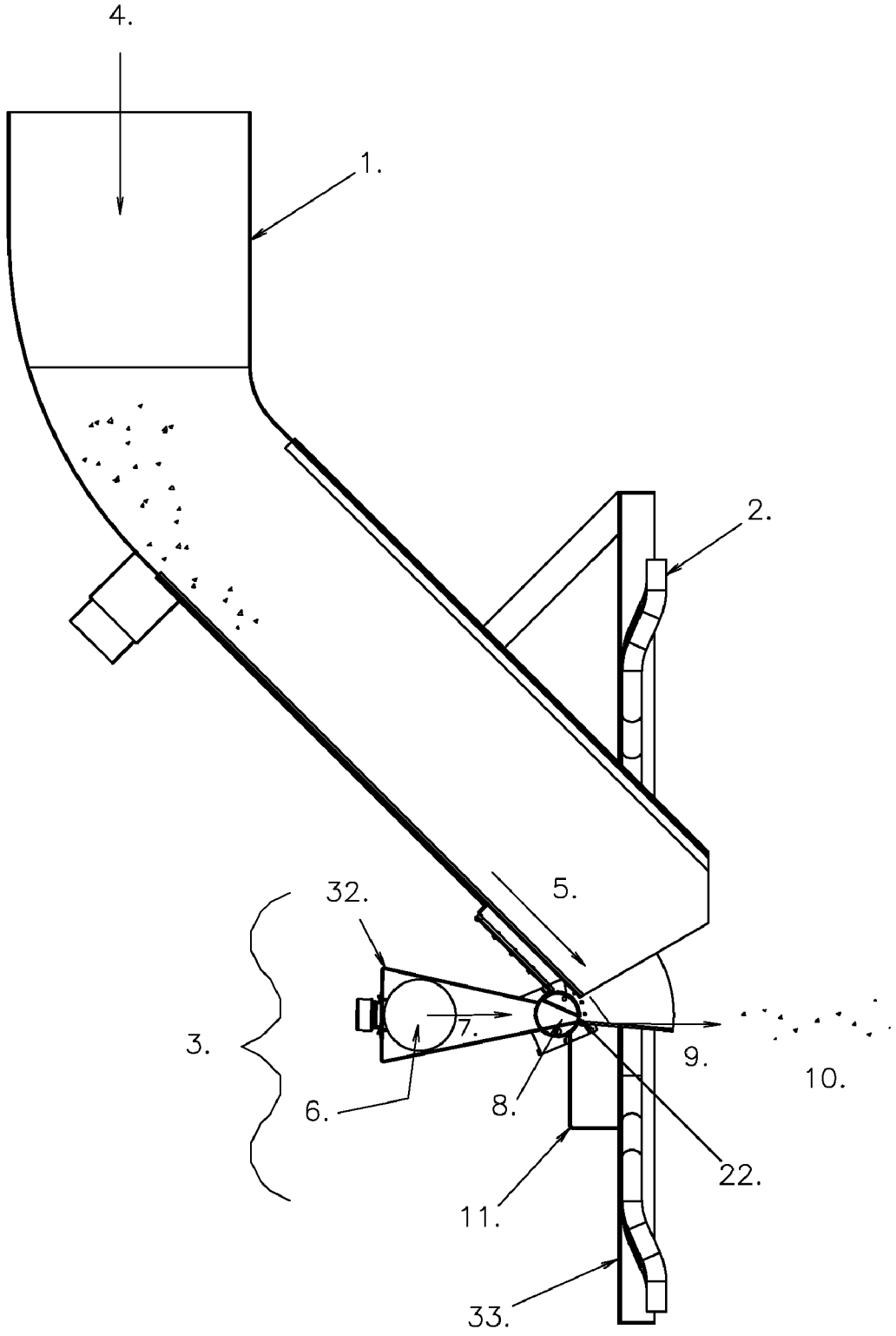
FIG. 1 is a sectional side view elevation of a typical fuel chute, boiler tube wall, and a preferred embodiment of a fuel distributor of the present invention.

The accompanying drawings are intended to aid in understanding the present invention and, unless otherwise indicated, are not drawn to scale.

DETAILED DESCRIPTION OF PREFERRED EMBODIMENTS

Although pneumatic solid fuel distributors have been in service for many years, applicants have found that the current state of the art suffers from significant deficiencies, including poor control of the fluid media; poor nozzle design; poor alignment of the pneumatic nozzle, orifice, and trajectory plate; poor serviceability and maintenance access; and poor observational access.

Although prior art mechanical and pneumatic fuel distributors improve the operation of the boiler, Applicants have found that current pneumatic distributors have several deficiencies. First, current designs have a poor orifice that does not efficiently control the flow of the pneumatic media. They either have a fixed orifice opening with an upstream damper to control the flow or an adjustable orifice poorly designed fluid dynamically. This results in high flow losses, high pressures required upstream, and/or higher flows required. Second, current designs generally have poorly designed nozzles or plenum boxes that impair the flow of the pneumatic media through the device. When a plenum is used, the transition from the plenum to the orifice is often not smooth resulting in high turbulence and high pressure drop into the orifice. When a smoothly transitioned nozzle is used, the nozzle portion is too small resulting in very high velocities that again require high pressures to overcome. Third, the angle of the trajectory plate on current designs is generally adjusted independently of the nozzle angle and in some cases the nozzle angle is fixed. This results in the jet of pneumatic media impinging on the trajectory plate at a poor angle, resulting again in flow losses, reduced functionality, and the requirement of higher flow and/or pressure. Fourth, current designs are generally integral with the solid fuel chutes and therefore not easily removable from the boiler for maintenance and service. They also suffer from lack of access in case they get plugged or otherwise have a problem. Fifth, current designs generally do not allow the boiler operators to observe the function of the device because there is no way to look through the orifice.

Various embodiments of the present invention solve one or more of the problems described above. Some embodiments incorporate a converging adjustable orifice that controls the flow of the pneumatic media independently of the pressure and is designed to maintain the momentum of the pneumatic media as it passes through the orifice. This reduces the pressure and kinetic energy losses upstream, reducing the pressure and flow rates required to evenly distribute fuel. Some embodiments of the present invention incorporate a fixed angle between the nozzle, orifice, and trajectory plate to maximize the efficiency of the device. The pneumatic media then always impinges on the trajectory plate at a preferred angle, reducing the flow rate and pressure required to evenly distribute the fuel. Some embodiments of the present invention incorporate a viewing window that is aligned with the orifice and allows the operators to observe the operations of the distributor. Some embodiments of the present invention incorporate a cleaning port that permits an operator to clean out the distributor without disassembling it and removing it from the boiler. Some embodiments of the present invention are not integral with the sold fuel chutes and can be readily removed from the boiler for maintenance.

Referring to FIG. 1, which shows a preferred embodiment of a solid fuel distributor of the present invention, a fuel chute 1 is rigidly attached to a boiler 33 and passes through a tube wall 2. A fuel distributor 3 is rigidly attached by means of a mounting frame 11 to both the fuel chute 1 and the boiler 33. Fuel enters the chute at the top 4, passes down the chute and exits at the bottom 5. Pneumatic media 6, either air or recirculated flue gas or both, enters through the side of a nozzle 32 and passes through a converging section 7, then through a converging orifice damper 8. The solid fuel lands on a plate 9 and is blown off, as shown by the arrow, into the boiler 10.

Figure 2:
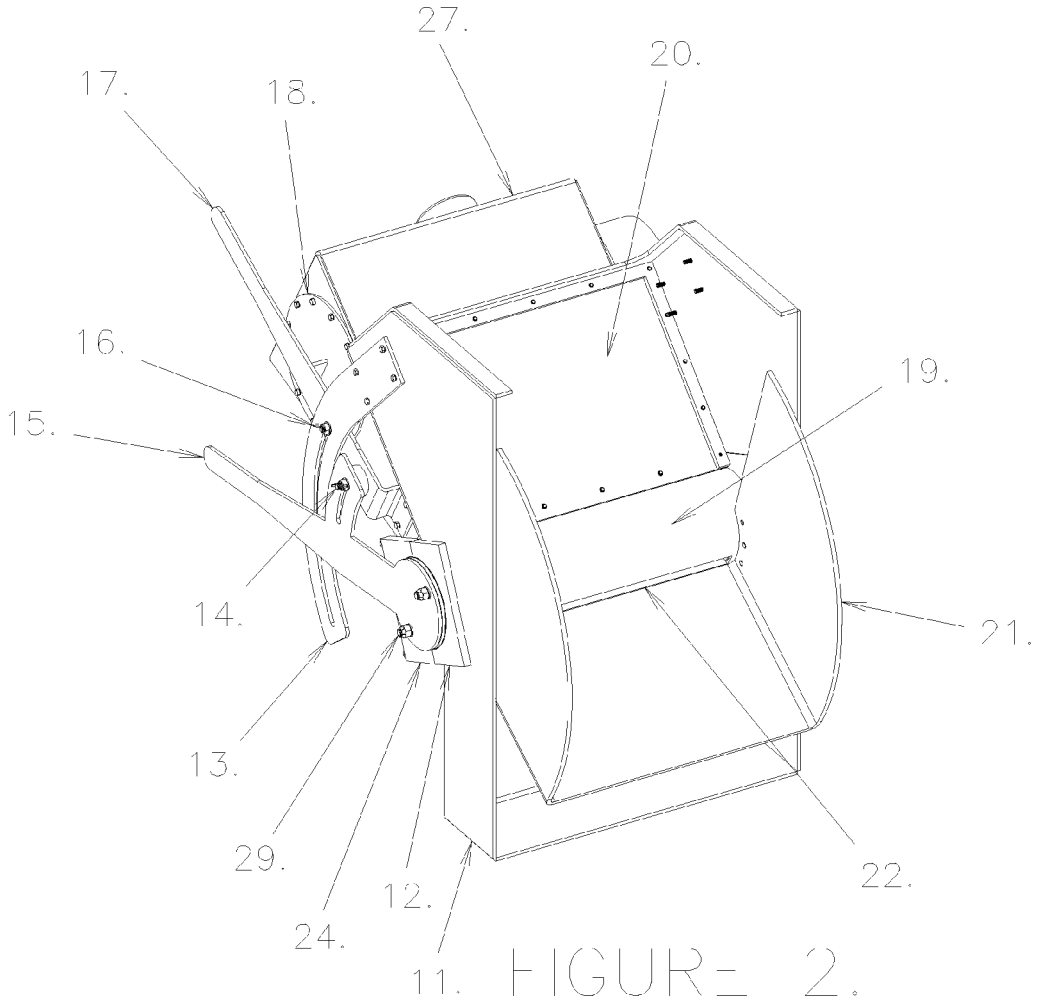
FIG. 2 is an isometric view of the preferred embodiment of FIG. 1 shown from inside the boiler.
Figure 3:
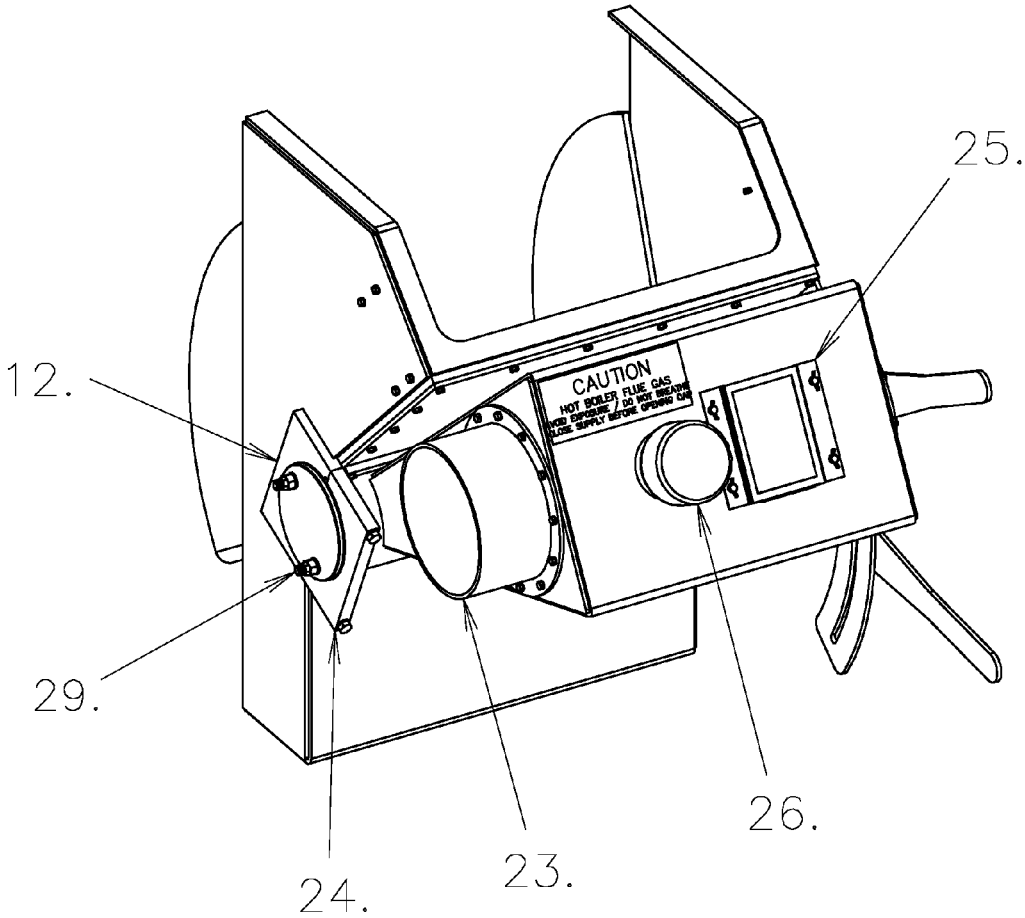
FIG. 3 is an isometric view of the preferred embodiment of FIG. 1 shown from outside the boiler.

Referring to FIG. 2 and FIG. 3, the preferred embodiment includes a mounting frame 11 incorporating two pivot blocks 12, an angle locking bracket 13, and an angle locking bolt 16. An orifice chamber 19 is cylindrical in form, pivotally mounted through the pivot blocks 12, and rigidly connected to a converging nozzle section 27 and a trajectory plate 21. Converging nozzle section 27 has a cross section that tapers, that is, gets narrower, in the direction of the boiler. To adjust the angle of the nozzle-orifice-trajectory plate assembly, the locking bolt 16 is loosened and moved through the slot in the angle locking bracket 13 by means of a handle 17. When the desired angle is reached the locking bolt 16 is tightened. An orifice opening 22 is adjusted by loosening locking bolt 14, and then adjusting handle 15 is moved to the desired location and locking bolt 14 is retightened.

To remove the nozzle-orifice-trajectory plate assembly from the boiler, an access plate 20 and pivot block caps 24 are removed, and the assembly can be withdrawn. To seal the removable portion against the escape of boiler gas the pivot blocks 12 and the pivot block caps 24 contain o-rings (not shown) riding against the outside surface of the orifice chamber 19. In a preferred embodiment, the trajectory plate 21 is removable from the nozzle-orifice assembly 27, 19 to facilitate replacement. The trajectory plate is subject to erosion from the solid fuel and heat of the boiler and will require periodic replacement. Another feature of some embodiments of the invention is that an inlet pipe 23 and adjusting means 13, 14, 15, 16, and 17, are reversible from one side to the other to accommodate the desired side to feed the pneumatic media to the fuel distributor. To accomplish this, adjusting handle 17 incorporates a cover plate 18 to seal the hole in the unused side of nozzle 27.

Additional features of some embodiments of the invention include a viewing glass 25 and an access port 26, both mounted on the face of the nozzle 27. Because the pneumatic media is fed from the side, the face of the nozzle is clear of obstructions providing room for the viewing glass and access port. Furthermore, because the nozzle-orifice-trajectory plate are all pivotally interconnected, the viewing glass and access port are always aligned with the orifice and trajectory plate thereby ensuring the proper angle to view the function of the distributor.

Figure 4:
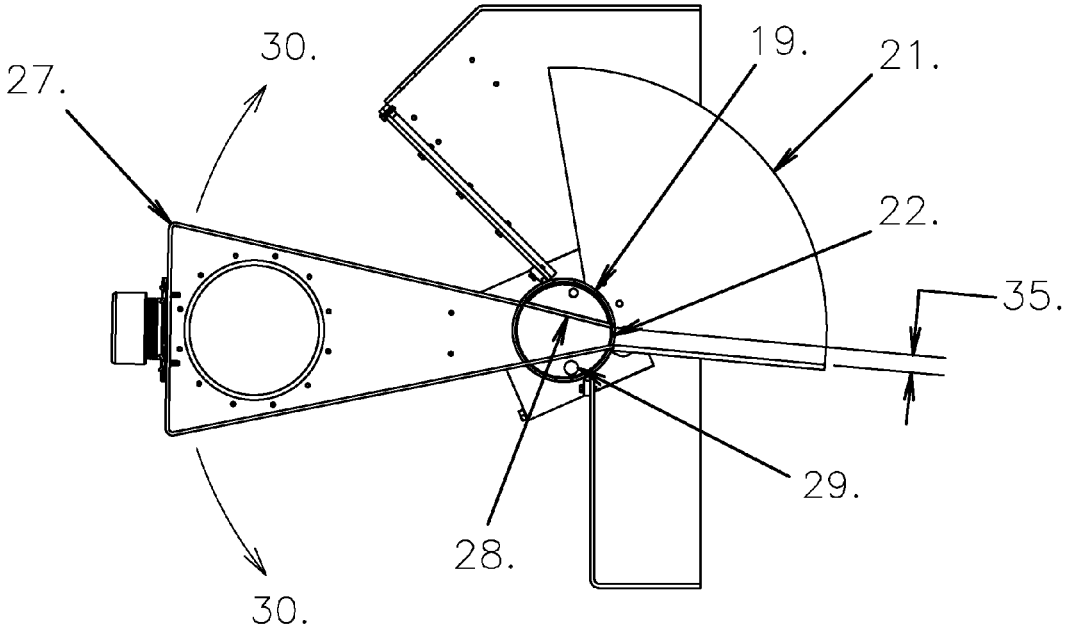
FIG. 4 is a sectional side view elevation of preferred embodiment of FIG. 1 showing the orifice damper fully open.
Figure 5:
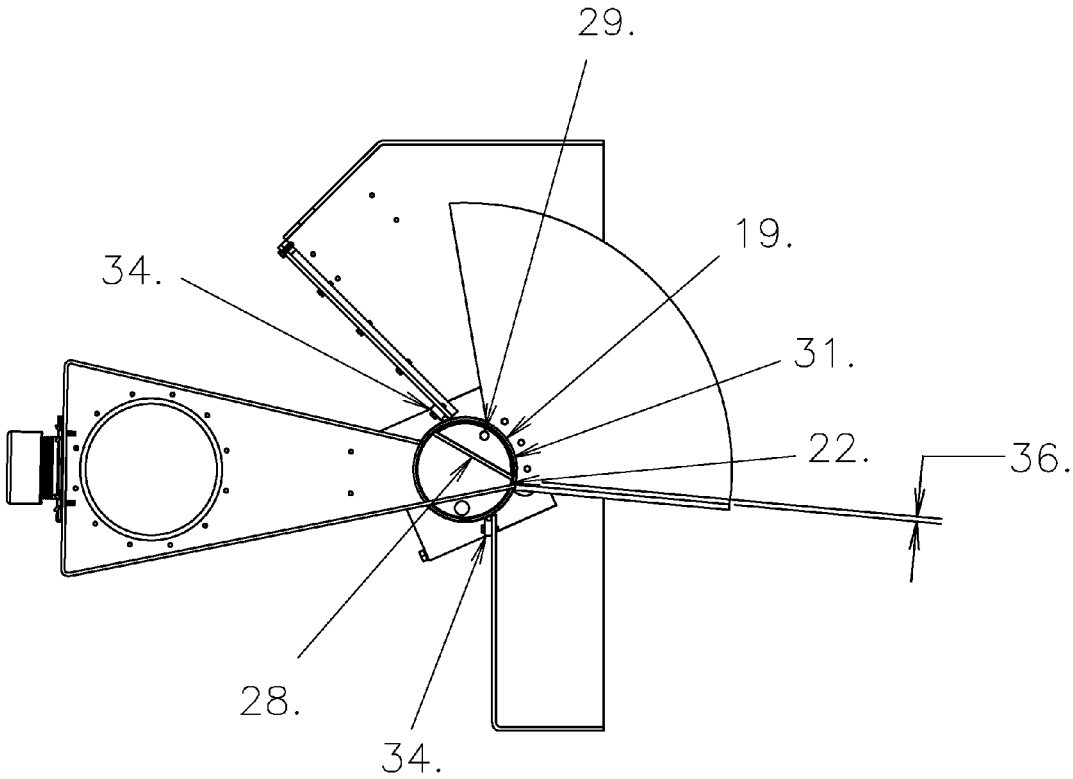
FIG. 5 is a sectional side view elevation of preferred embodiment of FIG. 1 showing the orifice damper partially closed.

Now referring to FIG. 4 and FIG. 5, the nozzle-orifice-trajectory plate assembly 27, 19, 21 can rotate through an angle 30 of approximately plus or minus 30 degrees. Within the orifice chamber 19 resides the damper 28 which is semi-cylindrical on top and flat on the bottom such that the semi-cylindrical top part is concentric with and immediately adjacent to the inside radius of the orifice chamber 19. The damper 28 is rotatably mounted within the orifice chamber 19 and connected to the adjusting handle 15 (FIG. 2) by means of the tie rods 29. The damper 28 provides non-parallel surfaces that form between them a region which tapers in the direction of the orifice opening into the boiler, the size of the orifice opening being adjustable by changing the relative position or orientation of the surfaces, which are configured to guide the pneumatic media toward the orifice. In the embodiment described, the lower surface of the nozzle is fixed, while the upper surface of the damper rotates to reduce the size of the opening. In other embodiments, the lower surface or both surfaces may be rotated or translated to change the size of the opening.

FIG. 4 shows the damper 28 in the full open position and FIG. 5 shows the damper 28 in a partially closed position. The pneumatic media exits at the end of the damper. The combination of nozzle 32 and damper 28 provides a converging path toward the orifice 22. The damper forms part of a converging adjustable orifice. As shown in FIG. 4, the converging nozzle section transitions smoothly into the converging adjustable orifice defined in part by the damper. As shown in FIG. 5, the transition may be less smooth depending on the adjustment of the damper, and the passage may widen somewhat between the converging nozzle and the converging adjustable orifice.

Prior art pneumatic solid fuel distributors use dampers that are typically parallel plates that throttle the flow of the pneumatic media into a plenum upstream of the nozzle, which reduces the kinetic energy of the pneumatic media and therefore more pneumatic media at higher pressure is required to distribute the fuel from the trajectory plate. The embodiment described above essentially uses a damper positioned at the end of the nozzle as an adjustable orifice that not only controls the size of the orifice, but also provides a converging cross section to guide the flow of the pneumatic media. The pneumatic media in the embodiment described above is directed smoothly along the path with reduced pressure loss and energy loss, when compared to fluid opening into a plenum and then exiting through an orifice. By using a nozzle and damper that provide a converging path that funnels, rather than blocks, the pneumatic media, the kinetic energy of the pneumatic media exiting the orifice is greater than in the prior art designs, and less media is required to distribute the fuel. This is a great advantage in application in which the pneumatic media, such as flue gases, have limited availability.

When the damper 28 is partially or fully closed, the semi-cylindrical top portion of the damper covers the unused portion of the orifice 31. This prevents solid fuel particles from entering the orifice chamber when the nozzle-orifice-trajectory plate assembly is tilted with the trajectory plate pointing upward by preventing solid fuel from sliding down the fuel chute and entering the orifice chamber on top of the damper plate, which could block the plate from rotating. To seal the cylindrical surfaces of the orifice chamber 19 against escaping boiler gas, adjustable seal bars 34 ride against the orifice chamber 19. The bars are machined with a groove to accept o-ring strips along their lengths.

The present invention includes several novel aspects that provide various advantages, and not all embodiments of the invention will use all aspects. Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A solid fuel distributor, comprising:

a trajectory plate onto which fuel is directed;

a converging nozzle for directing a pneumatic media through an orifice for injecting fuel from the trajectory plate into a boiler;

a frame supporting the trajectory plate and the nozzle, the nozzle and the trajectory plate being fixed relative to each other so as to maintain a constant angle between the nozzle and the trajectory plate, and the nozzle and the trajectory plate being pivotable with respect to the frame so that the angle at which fuel is introduced into the boiler can be adjusted when the frame is mounted onto a boiler without changing the angle between the nozzle and the trajectory plate; and a first mechanism for adjusting the position of the orifice opening and a second mechanism for adjusting the orientation of the nozzle and trajectory plate relative to the frame, the first and second mechanism being mountable on either side of the mounting frame.

2. The solid fuel distributor of claim 1 in which the orifice is adjustable.

3. The solid fuel distributor of claim 1 in which the orifice is formed at the end of the nozzle by non-parallel surfaces that form between them a region which tapers in the direction of the orifice, the size of the orifice being adjustable by changing the angle between the surfaces or the position of the surfaces, the surfaces guiding the pneumatic media through the orifice.

4. The solid fuel distributor of claim 1 in which the pneumatic media is introduced into the distributor through a pneumatic fuel inlet, and in which the frame is adapted to permit the pneumatic fuel inlet to be positioned on either side of the frame.

5. A pneumatic distributor for distributing solid fuel into a boiler, comprising:

a trajectory plate for receiving fuel from a fuel chute;

a nozzle for providing a pneumatic media to distribute fuel from the trajectory plate into a boiler, the nozzle having a cross section that tapers in the direction of the boiler;

an orifice positioned at the tapered end of the nozzle, the orifice having an adjustable opening to control the pneumatic media flowing through the nozzle, the orifice being formed at the end of the nozzle by non-parallel surfaces that form between them a region which tapers in the direction of the orifice, the size of the orifice being adjustable by changing the relative position or orientation of the surfaces, the surfaces configured to guide the pneumatic media toward the orifice; and the nozzle includes a damper that resides inside a hollow cylindrical chamber, the damper including a semi-cylindrical upper portion and a flat lower portion that provides one of the non-parallel surfaces that tapers in the direction of the orifice.

6. The pneumatic distributor of claim 5 in which the nozzle and the trajectory plate are supported so that the angle between the trajectory plate and a boiler wall is adjustable when the pneumatic distributor is mounted on a boiler and the angle between the nozzle and the trajectory plate remains fixed as the angle between the trajectory plate and the boiler is adjusted.

7. The pneumatic distributor of claim 5 in which a portion of the nozzle forms one of the non-parallel surfaces that forms a portion of the orifice.

8. The pneumatic distributor of claim 5 in which the damper is concentric with the cylindrical hollow chamber and rotatably mounted therein.

9. The solid fuel distributor of claim 5 further comprising at least one sealing bar positioned against the semi-cylindrical upper portion to prevent the escape of boiler gas to the environment outside the boiler and the ingress of outside air into the boiler.

10. The pneumatic distributor of claim 5 in which the trajectory plate is fixed to the end of the adjustable orifice so that the trajectory plate is substantially aligned with the flow of pneumatic media through the orifice.

11. The pneumatic distributor of claim 5 further comprising a mounting frame supporting the trajectory plate and nozzle, the nozzle and the trajectory plate being fixed relative to each other so as to maintain a constant angle between the nozzle and the trajectory plate and the trajectory plate and nozzle being pivotally mounted onto the frame.

12. The pneumatic distributor of claim 5 further comprising a viewing glass providing line of sight viewing through the adjustable orifice and along the top of the trajectory plate.

13. The pneumatic distributor of claim 5 further comprising an access port providing line of sight access through the adjustable orifice and along the top of the trajectory plate.

14. A solid fuel boiler, comprising:

boiler walls including tubes for transporting a liquid, the boiler walls defining a boiler interior;

a chute for supplying solid fuel to the boiler interior; and a pneumatic distributor for distributing solid fuel from the chute into the boiler interior, comprising:

a trajectory plate onto which fuel is directed;

a converging nozzle for directing a pneumatic media through an orifice for injecting fuel from the trajectory plate into a boiler;

a frame supporting the trajectory plate and the nozzle, the nozzle and the trajectory plate being fixed relative to each other so as to maintain a constant angle between the nozzle and the trajectory plate, and the nozzle and the trajectory plate being pivotable with respect to the frame so that the angle at which fuel is introduced into the boiler can be adjusted when the frame is mounted onto a boiler without changing the angle between the nozzle and the trajectory plate; and a first mechanism for adjusting the position of the orifice opening and a second mechanism for adjusting the orientation of the nozzle and trajectory plate relative to the frame, the first and second mechanism being mountable on either side of the mounting frame.

15. A solid fuel boiler, comprising:

boiler walls including tubes for transporting a liquid, the boiler walls defining a boiler interior;

a chute for supplying solid fuel to the boiler interior; and a pneumatic distributor for distributing solid fuel from the chute into the boiler interior, comprising:

a trajectory plate for receiving fuel from a fuel chute;

a nozzle for providing a pneumatic media to distribute fuel from the trajectory plate into a boiler, the nozzle having a cross section that tapers in the direction of the boiler;

an orifice positioned at the tapered end of the nozzle, the orifice having an adjustable opening to control the pneumatic media flowing through the nozzle, the orifice being formed at the end of the nozzle by non-parallel surfaces that form between them a region which tapers in the direction of the orifice, the size of the orifice being adjustable by changing the relative position or orientation of the surfaces, the surfaces configured to guide the pneumatic media toward the orifice; and the nozzle includes a damper that resides inside a hollow cylindrical chamber, the damper including a semi-cylindrical upper portion and a flat lower portion that provides one of the non-parallel surfaces that tapers in the direction of the orifice.

16. The solid fuel boiler of claim 15 in which the pneumatic distributor nozzle and the trajectory plate fixed in relation to each other and pivotable as a unit with respect to one of the boiler walls to change the angle at which the solid fuel is distributed to the boiler interior.

* * * * *